US005361466A

United States Patent [19]

Robertson et al.

[11] Patent Number: 5,361,466

[45] Date of Patent: Nov. 8, 1994

[54] METHOD OF FORMING A BLANKET OF UNIFORM THICKNESS

[75] Inventors: John S. Robertson; Stephen E. Gross, both of Littleton, Colo.

[73] Assignee: Schuller International, Inc., Denver, Colo.

[21] Appl. No.: 138,321

[22] Filed: Oct. 18, 1993

[51] Int. Cl.[5] ..... B32B 31/00; D04H 18/00

[52] U.S. Cl. ..... 28/158; 28/111; 28/141; 19/302; 428/60; 428/300; 156/148; 156/266

[58] Field of Search ..... 156/62.8, 148, 265, 156/266; 19/296, 302, 161.1; 28/107, 111, 141, 158; 428/57, 60, 300

[56] References Cited

U.S. PATENT DOCUMENTS

| | | | |
|---|---|---|---|
| 2,758,630 | 8/1956 | Hodge | 156/266 |
| 3,651,543 | 3/1972 | Loo et al. | 19/161.1 |
| 3,856,612 | 12/1974 | McGinnis, Jr. | 19/161.1 X |
| 4,186,470 | 2/1980 | Stoller | 19/161.1 X |
| 4,473,609 | 9/1984 | Caldwell | 156/148 X |
| 4,683,624 | 8/1987 | Dufour | 28/141 |
| 5,058,241 | 10/1991 | Haigh et al. | 19/150 |
| 5,111,552 | 5/1992 | Laurén et al. | 156/62.4 X |

*Primary Examiner*—Mark Osele
*Attorney, Agent, or Firm*—Cornelius P. Quinn

[57] ABSTRACT

A synthetic microfiber blanket having a uniform thickness is formed from a nonuniform blanket having thin or feathered lateral edges. The nonuniform blanket is cut transversely into a plurality of discrete pieces of blanket of uniform length. The plurality of discrete pieces of blanket are arranged with the thin lateral edges in overlapping relationship to form a blanket of a desired width and thickness. The overlapped, discrete pieces of blanket are then joined into an integral blanket of uniform width and thickness by entangling together fibers of adjacent pieces of blanket. A scrim backing can be incorporated into the blanket for added strength and dimensional stability.

10 Claims, 1 Drawing Sheet

FIG. 1
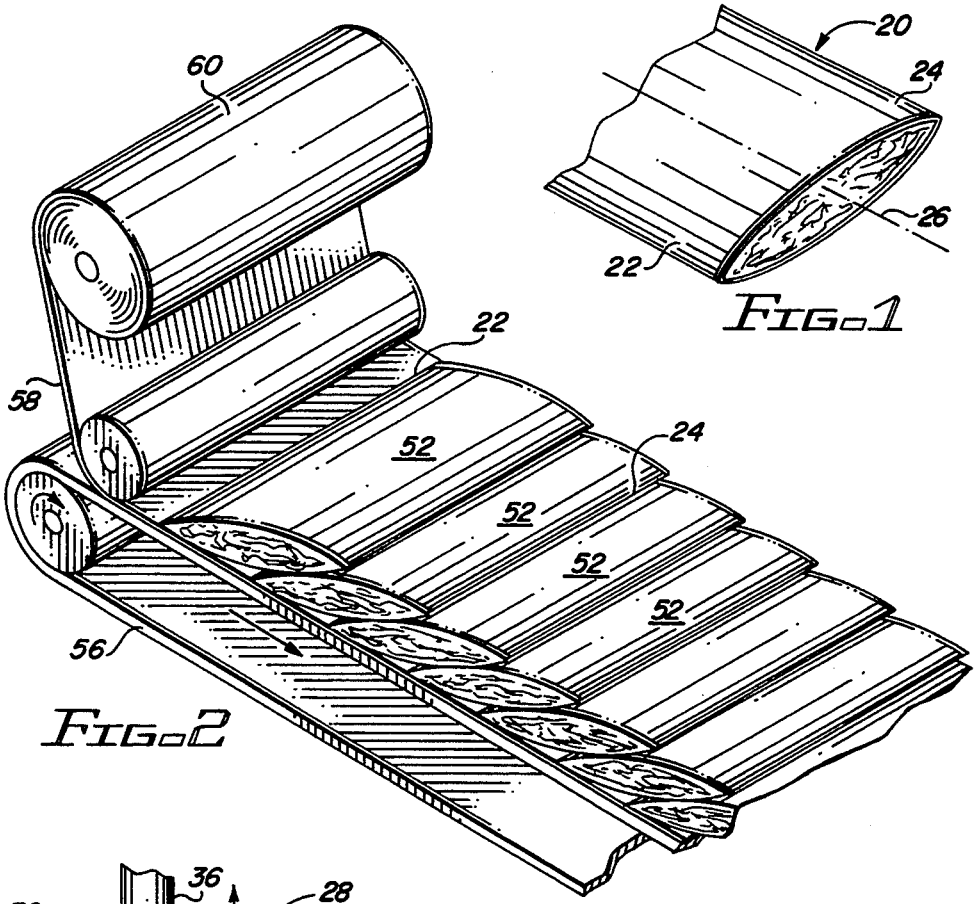
FIG. 2
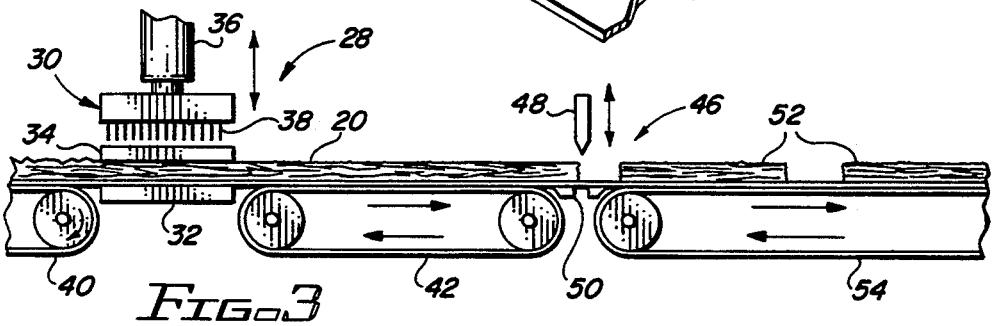
FIG. 3
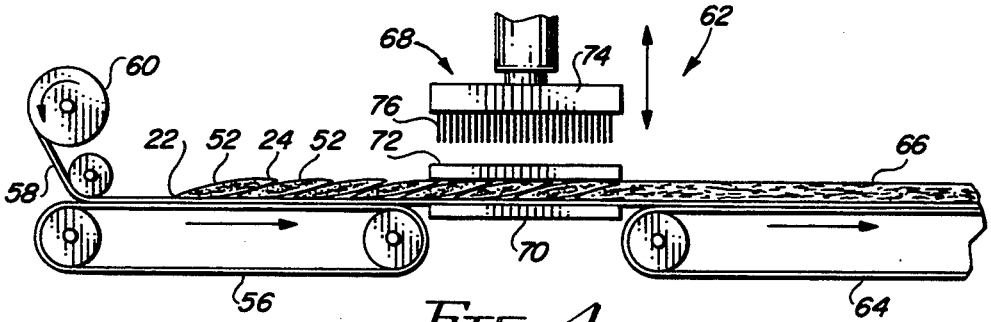
FIG. 4

METHOD OF FORMING A BLANKET OF UNIFORM THICKNESS

BACKGROUND OF THE INVENTION

The present invention is directed to a method of forming a synthetic microfiber blanket of uniform thickness and width from a nonuniform synthetic microfiber blanket with feathered or thin lateral edges.

In certain processes for the production of synthetic fiber blankets used as insulation; air, gas or liquid filtration media; etc., the blanket collected directly from the fiberization process does not have a uniform thickness across the width of the blanket. In one such process, the synthetic fiber blanket collected is thicker along its central longitudinal axis than along its lateral edges. The relatively thin or feathered lateral edges of the blanket normally have to be trimmed to form a blanket of more uniform thickness across its width. The trimming of the lateral edges is a basically nonproductive, but necessary step in the manufacturing operation which produces scrap. Thus, there has been a need to eliminate this step of the manufacturing operation without adversely affecting the insulation or filtration media product.

SUMMARY OF THE INVENTION

The method of the present invention solves the problems of the prior art and provides some additional advantages not present in the prior art processes. In the process of the present invention, synthetic microfibers, such as thermoplastic polymeric microfibers, are formed by continuously extruding the thermoplastic polymer through a large number of small holes in a rotating spinner. The synthetic microfibers are collected directly from the fiberizing process to form a blanket which is thicker along its central longitudinal axis than along its lateral edges. The blanket thus collected is then cut transversely into a plurality of discrete pieces of uniform length. These individual pieces of blanket are arranged in overlapping relationship with the thin or feathered lateral edges of the individual pieces being overlapped to form a blanket of a substantially uniform thickness across its entire width. The individual pieces of blanket are then joined to form one integral blanket by entangling together fibers of adjacent pieces of blanket in the areas where the adjacent pieces of blanket overlap.

Thus, the process of the present invention produces a synthetic microfiber blanket which is substantially uniform in thickness throughout its length and width. The process can produce blankets of uniform thickness ranging from 1/32 of an inch thick to greater than 1 inch thick. The blanket formed contains only microfibers and is free of coarse diameter staple fibers commonly used during the processing of such blankets for binding, lofting or ease of processing. The blanket formed is an extremely efficient filter media which is free of voids passing through the blanket which would make the blanket unacceptable for air filtration and some insulating applications. When binders are used in filtration blankets to bond the fibers of the blankets together, the binders may leach out into the filtrate in certain applications. No binders are required to form the blanket by the process of the present invention. In addition, the process enables the production of continuous blankets of any desired length and of uniform width having a much greater width than possible using prior art processes.

BRIEF DESCRIPTION OF THE DRAWINGS

FIG. 1 is a perspective view of a portion of a nonuniform blanket collected directly from a fiberizing process to show the cross-section of the blanket with its thin or feathered lateral edges.

FIG. 2 is a perspective view of a plurality of discrete pieces of blanket arranged in overlapping relationship prior to the needling of the discrete pieces of blanket to join the pieces together into an integral blanket of uniform width and thickness.

FIG. 3 is a schematic elevational view showing the needling of the nonuniform blanket of FIG. 1 and the cutting of that blanket into discrete pieces of uniform length.

FIG. 4 is a schematic elevational view showing the overlapping discrete pieces of nonuniform blanket being needled to form an integral blanket of uniform thickness and width.

DESCRIPTION OF THE PREFERRED EMBODIMENTS

FIG. 1 shows a portion of a continuous, nonuniform, synthetic microfiber blanket 20 collected directly from a fiberization process, such as, a rotary fiberization process wherein the fibers collected to form the blanket are extruded through a large number of holes in a rotating spinner. The synthetic fibers of the blanket 20 are typically about 2 microns to about 10 microns in diameter and can be any of various thermoplastic polymeric microfibers, such as, poly butyl terphalate (polyester), polycarbonate, nylon, polypropylene, acrylic, or polyethylene fibers.

As shown in FIG. 1, the blanket 20 has thin or feathered lateral edges 22 and 24 and is thicker along the central longitudinal axis 26. In addition to the thin lateral edges 22 and 24, the collection of fibers to form the blanket 20 is sometimes irregular in other respects creating areas of varying density within the blanket.

FIG. 3 shows the continuous, nonuniform synthetic microfiber blanket 20 passing from a commercial fiberization station, not shown, into a needling or tacking station 28. The needling or tacking station 28 is used in the process of the present invention, as required, to give the blanket 20 additional integrity. When the needling or tacking station is used in the process, the blanket 20 is periodically needle punched as the blanket moves through the needling station 28 from conveyor 40 to conveyor 42. During each needle punching cycle, barbed needles are passed down through the blanket 20 and then retracted up through the blanket to further entangle the microfibers of the blanket and give the blanket more integrity.

The needling or tacking station 28 has a needle punch 30, such as a Fehrer needle punch capable of up to 2500 needle punches per minute. The needle punch 30 comprises a lower, fixed, perforated, bed plate 32; an upper, adjustable, perforated stripper plate 34; and a needle board 36 with barbed needles 38 (preferably 36 gauge, star blade needles) depending therefrom in a preselected pattern. In operation, the blanket 20 slides over the lower, fixed bed plate 32 from conveyor 40 to conveyor 42. The lower, fixed bed plate 32 supports the blanket 20 during the needling or tacking operation and is perforated with the same hole pattern as the needle pattern on the needle board 36 to receive the points of the needles projecting through the blanket during the punching operation. The upper adjustable, perforated, stripper plate 34 is adjusted to a predetermined spacing above the lower bed plate 32, less than the thickness of the blanket 20, and is fixed in that position to maintain the blanket 20 in a slightly compressed state during the needle punching operation. The perforations in the upper stripper plate 34 have the same pattern as the needle pattern in the needle board 36 and register with the barbed needles 38 of the needle board 36 which pass down and back through the upper stripper plate 34 during the needling of the blanket 20.

The needle board 36 is driven by a conventional reciprocating drive mechanism which reciprocates the needle board in a vertical direction as shown by the arrows in FIG. 3. As portions of the blanket 20 move through the needling or tacking station 28, the needle board 36 is moved down passing the barbed needles 38 down through the perforations in the stripper plate 34, the blanket 20 and into the perforations in the bed plate 32. The needle board 36 is then retracted to its original position drawing the barbed needles 38 back up through the blanket 20 and the perforated stripper plate 34. This needle punching operation further entangles or interlocks the microfibers of the blanket to give the blanket greater integrity.

As shown in FIG. 3, the blanket 20 passes from the needling or tacking station 28 to a cutting or chopping station 46. The cutting or chopping station 46 comprises a conventional cutting or chopping unit, such as, reciprocating chopper 48 and a backing plate 50. As the blanket 20 passes through the cutting station 46 and over the backing plate 50, the blanket 20 is cut, in a direction perpendicular to its longitudinal axis, into discrete pieces of blanket 52 of a predetermined length by the chopper 48 which reciprocates in a vertical direction as shown by the arrows in FIG. 3. The discrete blanket pieces 52 are then taken away from the cutting station 46 by conveyor 54. The length of the blanket pieces 52 is only limited by the width of the downstream needling operation where the blanket pieces are joined together to form an integral blanket of uniform width and thickness.

The discrete pieces of blanket 52 are removed from the conveyor 54, reoriented 90 degrees, and placed on conveyor 56 in overlapping relationship. As shown in FIG. 2, the discrete blanket pieces 52 are arranged on the conveyor 56 with the lateral edges 22 and 24 of the individual blanket pieces 52 overlapped to form a blanket of uniform thickness and width. As shown in FIGS. 2 and 4, the pieces of blanket 52 can be placed on a continuous, scrim backing sheet or mat 58 which becomes an integral part of the finished product to provide the product with added strength and dimensional stability. The scrim backing sheet or mat 58 is fed onto the upper surface of the conveyor 56 from a roll 60.

FIG. 4 shows the overlapped pieces of blanket 52 passing through the second needling station 62 of the process of the present invention. The overlapped pieces of blanket 52 are periodically needle punched as the pieces of blanket 52 pass through the needling station 62 from conveyor 56 to conveyor 64. During each needle punching cycle, barbed needles are passed down through the overlapped pieces of blanket 52 and then retracted up through the pieces of blanket to entangle microfibers of adjacent pieces of blanket together and thereby join the pieces of blanket 52 into a continuous integral blanket 66 of uniform thickness and width. When a scrim backing sheet or mat 58 is used as a backing for the particular product being produced, the needles also pass through the scrim or mat to entangle or interlock fibers of the scrim or mat with the microfibers of the blanket and join the scrim or mat to the blanket 66.

The needling station 62 has a needle punch 68, such as a Fehrer needle punch capable of up to 2500 needle punch cycles per minute. The needle punch 68 comprises a lower, fixed, perforated plate 70; an upper, adjustable, perforated stripper plate 72; and a needle board 74 with barbed needles 76 (preferably 36 gauge, star blade needles) depending therefrom in a preselected pattern. In operation the pieces of blanket 52 slide over the lower, fixed bed plate 70 from conveyor 56 to conveyor 64. The lower, fixed bed plate 70 supports the blanket pieces 52 during the needling operation and is perforated with the same hole pattern as the needle pattern on the needle board 74 to receive the needle points projecting through the blanket pieces during the punching operation. The upper adjustable, stripper plate 72 is adjusted to a predetermined spacing above the lower bed plate 70 less than the thickness of the integral uniform blanket 66 and is fixed in that position to maintain the blanket pieces 52 entering the needle punch 68 and the integral, uniform blanket 66 leaving the needle punch in a slightly compressed state during the needle punching operation. The perforations in the upper stripper plate 72 have the same pattern as the needle pattern in the needle board 74 and register with the barbed needles 76 of the needle board which pass down and back through the upper stripper plate 72 during the needling of the blanket pieces 52 to join the pieces together to form the continuous, integral, uniform blanket 66.

The needle board 74 is driven by a conventional reciprocating drive mechanism which reciprocates the needle board in a vertical direction shown by the arrows in FIG. 4. As portions of the blanket pieces 52 move through the needling station 62, the needle board 74 is moved down passing the barbed needles 76 down through the perforations in the stripper plate 72, the pieces of blanket 52, the scrim backing sheet 58 (if present) and into the perforations in the bed plate 70. The needle board 74 is then retracted to its original position drawing the barbed needles 76 back up through the scrim, if present, the blanket pieces 52 and the perforated stripper plate 72. The needle punching operation thereby entangles or interlocks microfibers of adjacent overlapped blanket pieces together to join the blanket pieces together and form the continuous, integral uniform blanket 66. If a scrim backing sheet or mat 58 is being incorporated into the finished product, fibers of the scrim sheet are entangled or interlocked with microfibers of the blanket pieces 52 to secure the scrim backing sheet to the underside of the blanket 66.

A test was performed on a blanket formed in accordance with the present invention to determine if the needling of the blanket pieces 52 to form the integral uniform blanket 66 would leave pin holes in the blanket 66 and make the blanket unsuitable as an air filter. The testing unit used in the test was a Climet CL-6300 Laser Particle Counter. As the results of the test contained in the following table show, the blanket performed well indicating that the blanket did not contain pin holes through which air could flow unfiltered thereby making the blanket unsuitable as a filter media. The blanket tested was made of polycarbonate fibers having an average fiber diameter of about 3 microns. The blanket was backed by a REM(N) filter backing. The test conditions were as follows: air flow 100 cfm; pressure drop 1.000 Hg; temperature 77.2 degrees Fahrenheit; relative humidity 42.8%; and counter air flow 0.100 cfm.

| PARTICLE SIZE MICRONS | PARTICLE COUNT UPSTREAM | PARTICLE COUNT DOWNSTREAM | EFFICIENCY % |
|---|---|---|---|
| .19–.3 | 99,534 | 8,571 | 91 |
| .3–.5 | 36,148 | 1,914 | 94 |
| .5–1 | 20,705 | 286 | 98 |
| 1–3 | 659 | 2 | 99 |
| 3–5 | 27 | 1 | 96 |
| >5 | 7 | 0 | 100 |
| TOTAL | 157,080 | 10,774 | 93 |

The blanket performed at an overall efficiency of 93%. Thus, the method of the present invention forms an integral, blanket of uniform thickness without pin holes which would make the blanket unsuitable for use as air filter media.

The number of needle punching cycles per minute and the density of the needle pattern used on the needle board at each needling station will be determined by the speed of the blanket passing through the needling station and the physical properties required of the product.

What is claimed is:

1. A method of forming a synthetic microfiber blanket having a uniform thickness, comprising:

providing a continuous synthetic microfiber blanket having thin lateral edges; said blanket being thicker in the middle along the central longitudinal axis of said blanket than along the lateral edges of said blanket;

cutting said synthetic microfiber blanket, in a direction transverse to said longitudinal axis of said blanket, into a plurality of discrete pieces of blanket of uniform length;

arranging a plurality of said discrete pieces of blanket with said thin lateral edges in overlapping relationship to form a second blanket of a desired width and thickness; and joining said discrete pieces of blanket together into said second blanket.

2. The method of claim 1, wherein: said discrete pieces of blanket are joined together by needling whereby microfibers of adjacent discrete pieces of blanket are entangled.

3. The method of claim 1, wherein: said discrete pieces of blanket are joined by entangling together microfibers of adjacent discrete pieces of blanket.

4. The method of claim 1, wherein: said synthetic microfiber blanket comprises thermoplastic polymer microfibers having an average fiber diameter between about 2 and about 10 microns.

5. The method of claim 1, wherein: said synthetic microfiber blanket is needled prior to cutting to entangle microfibers of said blanket and give said blanket more integrity.

6. The method of claim 1, including: securing a scrim backing to said second blanket.

7. The method of claim 6, wherein: said scrim backing is secured to said second blanket by entangling fibers of said scrim backing with microfibers of said second blanket.

8. A method of forming a synthetic microfiber blanket having a uniform thickness, comprising:

providing a continuous synthetic microfiber blanket having thin lateral edges; said blanket being thicker along the central longitudinal axis of said blanket than along said lateral edges of said blanket; and said blanket comprising thermoplastic polymer microfibers:

needling said blanket to entangle said microfibers and give said blanket more integrity:

cutting said synthetic microfiber blanket, in a direction substantially perpendicular to the central longitudinal axis of said blanket, into a plurality of discrete pieces of blanket of uniform length;

arranging said plurality of said discrete pieces of blanket with said thin lateral edges in overlapping relationship to form a second blanket of a desired width and thickness; and needling said plurality of discrete pieces of blanket to join said plurality of discrete pieces of blanket together by entangling together said microfibers of adjacent pieces of blanket.

9. The method of claim 8, including: securing a scrim backing to said second blanket.

10. The method of claim 9, wherein: said scrim backing is secured to said second blanket by entangling fibers of said scrim backing with microfibers of said second blanket.

* * * * *